US007163054B2

(12) United States Patent
Adams

(10) Patent No.: US 7,163,054 B2
(45) Date of Patent: Jan. 16, 2007

(54) BREECHBLOCK CONNECTORS FOR USE WITH OIL FIELD LINES AND OIL FIELD EQUIPMENT

(75) Inventor: James Murph Adams, Cypress, TX (US)

(73) Assignee: Control Flow Inc., Houston, TX (US)

( * ) Notice: Subject to any disclaimer, the term of this patent is extended or adjusted under 35 U.S.C. 154(b) by 170 days.

(21) Appl. No.: 10/827,653

(22) Filed: Apr. 19, 2004

(65) Prior Publication Data

US 2004/0256096 A1 Dec. 23, 2004

Related U.S. Application Data

(63) Continuation-in-part of application No. 10/601,946, filed on Jun. 23, 2003, now Pat. No. 7,040,393.

(51) Int. Cl.
*E21B 17/02* (2006.01)

(52) U.S. Cl. ..... 166/75.13; 166/242.6; 285/18

(58) Field of Classification Search ..... 166/360, 166/380, 382, 75.13, 242.6; 285/18
See application file for complete search history.

(56) References Cited

U.S. PATENT DOCUMENTS 3,421,580 A 1/1969 Fowler et al.
3,442,536 A 5/1969 Fowler
3,800,869 A 4/1974 Herd et al.
3,895,829 A 7/1975 Manson, Jr.
3,948,545 A 4/1976 Bonds
4,165,891 A 8/1979 Sullaway et al.
4,185,856 A * 1/1980 McCaskill ..... 285/18
4,209,191 A 6/1980 Lawson
4,290,482 A * 9/1981 Brisco ..... 166/75.13
4,540,053 A * 9/1985 Baugh et al. ..... 166/382
4,807,705 A 2/1989 Henderson et al.
5,069,288 A * 12/1991 Singeetham ..... 166/382

FOREIGN PATENT DOCUMENTS

GB 260140 10/1926
GB 2 114 631 A 8/1983

* cited by examiner

*Primary Examiner*—David Bagnell
*Assistant Examiner*—Matthew J. Smith
(74) *Attorney, Agent, or Firm*—Bracewell & Giuliani LLP; Anthony F. Matheny

(57) ABSTRACT

The invention is directed to breechblock connections to and between oil field equipment and oil field lines for use with oil field equipment associated with oil and gas exploration, drilling, and production. The oil field lines and oil field equipment of the invention include a breechblock connection for quick and easy removal and installation of the oil field lines to oil field equipment and to other oil field lines, and connections between different pieces of oil field equipment. Methods of connecting lines to oil field equipment and connecting one piece of oil field equipment to a second piece of oil field equipment are also disclosed.

29 Claims, 7 Drawing Sheets

BREECHBLOCK CONNECTORS FOR USE WITH OIL FIELD LINES AND OIL FIELD EQUIPMENT

RELATED APPLICATION

This application is a continuation-in-part of, and claims priority to, U.S. Non-Provisional patent application Ser. No. 10/601,946, filed Jun. 23, 2003 now U.S. Pat. No. 7,040,393.

BACKGROUND OF THE INVENTION

1. Field of the Invention

The invention relates to connections of pressure and non-pressure lines and conduits to oil field equipment or between various pressure and non-pressure lines and conduits, and in particular, breechblock connections between these various lines and conduits. The invention is also directed to use of breechblock connections between pieces of oil field equipment.

2. Description of Related Art

Various pieces of equipment associated with oil and gas exploration exist that must be connected to pressure and non-pressure lines or conduits (defined herein as "oil field lines") or to other pieces of oil field equipment. While oil field equipment and oil field lines may supply pressure through the lumen of the oil fields lines to the oil field equipment in order for the oil field equipment to control and operate valves and other mechanical components of the oil field equipment are known in the art, the use of breechblock connections with the oil field lines has not been known until the present application.

"Oil field equipment" is defined herein as any piece or component of oil and gas exploration, drilling, or production, which is connected to pressure or non-pressure lines or conduits whether upon land, sea, or sub-sea. Examples of oil field equipment includes, but is not limited to, pressure and non-pressure activated pieces of oil field equipment, such as tensioners, slip-joint assemblies, slip-joint tensioner assemblies, blowout preventers ("BOP"), top drives, standpipe manifolds, choke and kill manifolds, mud tanks, water tanks, pressure lubricators, wire line equipment, coiled tubing equipment, well-head adapters, bottom hole test adaptors, i.e., tree caps, and shale shakers. Oil field lines include any lines or conduits that are connected to oil field equipment and include, but are not limited to, choke and kill lines, kelly hose connections, top drive lines, standpipe manifold lines, mud tank hook-ups and lines, water tank hook-ups and lines, shale shaker hook-ups and lines, discharge lines, flare lines, supply lines, lines between floating vessels, boats and ships, pneumatic lines, hydraulic lines, mud lines, water lines, slurry lines, liquid natural gas lines, and fluid transfer lines.

Currently, the connections between the oil field lines and the oil field equipment and between pieces of oil field equipment include threaded connections, use of clamps, use of locking mechanisms such as pins, lug locks, or set screws, use of latch-dogs, and use of bolted flanges. However, all of these require large amounts of time and manpower to install and disconnect these connections resulting in well downtime. Therefore, it is desired in the art to be able to quickly and easily install and disconnect these connections.

While the breechblock connections of the invention can be used in all of the foregoing examples, the invention will be discussed in greater detail with respect to breechblock connections of pressure lines, and in particular, pressure lines associated with riser equipment, such as tensioners, slip-joint assemblies, slip-joint tensioner assemblies, and choke and kill lines for use on blowout preventers, and specifically, different sized blowout preventers.

Choke and kill lines for use with blowout preventer ("BOP") stacks also are well known in the art. In general, each BOP stack includes at least one choke line and one kill line. Each of the choke lines and the kill lines are releaseably connected to the BOP stack and a pressure source, e.g., hydraulic source, which are capable of providing pressure through the choke and kill lines to control the wellbore and BOP stack during drilling of oil and gas wells, etc.

In current practice, choke and kill lines are present on the BOP stack for oil or gas drilling. In some cases, a set of choke and kill lines may be connected to one size and pressure rated BOP stack and then later connected to a second size and pressure rated BOP stack. For example, the set of choke and kill lines may be rated at the highest working pressure and size for one BOP stack and then adapted to fit another size and working pressure BOP stack. The choke and kill lines remain the same for every use but require adaptation in order to be used with various sizes and working pressure rated BOP stacks.

This typically occurs when a BOP stack of one size is used for lower pressure applications and a second, larger, BOP stack is also required to address the high pressures on the wellhead or to accommodate the various volumes of oil or gas flowing through the BOP stack in consecutive applications. However, in current embodiments, the connector assembly between the BOP stack and each of the choke and kill lines can be different on the different sized BOP stacks. For example, a 21¼" BOP stack can have a smaller connection assembly for the choke and kill lines than a 13⅝" BOP stack.

Therefore, it is desired in the art to have a coupling system, such as a choke and kill line system, between each of the choke and kill lines and the BOP stack that is capable of withstanding high pressures and also provides quick and easy removal and installation, thereby reducing the amount of time that the well equipment is being readied for or is out of service. It is also desired in the art to have a coupling system, such as a choke and kill line system, between each of the choke and kill lines that permits each of the choke and kill lines to be connected to different sized BOP stacks universally and without requiring additional adaptation to do so.

Another concern of current coupling systems, and choke and kill line systems and other large line hydraulic or air control systems, is the amount of weight that the connections between the choke and kill lines and the BOP stack must sustain or the other pressure control systems must sustain. This concern increases as the size of the choke and kill lines or other pressure lines increase. Therefore, it is desired in the art to have a coupling system, or choke and kill line system, or other pressure line system, that assists in relieving some, if not all, of the weight forces of the choke and kill lines on the connections between the choke and kill lines and the BOP stack or on connections between pressure lines and other equipment.

As mentioned above, the present inventions address the foregoing concerns. Specifically, in one aspect of the present invention, the coupling system and choke and kill line systems, of the present invention include lines that can withstand the maximum amount of pressure envisioned on a particular wellhead or riser system and that can be used on various sized BOP stacks. This aspect of the present invention, therefore, provides a fast and efficient means of changing the choke and kill lines from one BOP stack, or other equipment, to another BOP stack or other equipment, by utilizing a connection designed specifically for this purpose. Accordingly, cost savings are realized with the connection of the choke and kill lines to the BOP stacks, or other lines to other equipment, requiring less time and manpower to accomplish.

Further, in another aspect of the invention, the coupling systems, and choke and kill line systems, of the present invention include one or more guide assemblies that can be secured to the BOP stack, or other support structure, e.g., the platform or riser superstructure, to alleviate some of the weight caused by the choke and kill lines on the connections of the choke and kill lines with the BOP stack.

Additionally, in another aspect of the invention, the connections of the oil field lines to oil field equipment and between pieces of oil field equipment of the present invention include a breechblock connection such that the connections can be easily and quickly installed and disconnected. Therefore, time savings are realized and less manpower is required to change from one piece of oil field equipment or oil field line to another piece of oil field equipment or oil field line.

Accordingly, prior to the development of the present invention, there has been no coupling system, which: provide quick and efficient connection of each of oil field lines, and other conduits or oil field equipment, with other pieces of oil field equipment; reduce the amount of manpower needed to remove and install oil field lines, and other conduits or oil field equipment, with other pieces of oil field equipment; provide quick and efficient connection of each of the oil field lines, and other conduits or oil field equipment, with other pieces of oil field equipment; and reduce the amount of manpower needed to remove and install the oil field lines, and other conduits or oil field equipment, with other pieces of oil field equipment. Therefore, the art has sought a coupling system, which: provide quick and efficient connection of each of oil field lines, and other conduits or oil field equipment, with other pieces of oil field equipment; reduce the amount of manpower needed to remove and install oil field lines, and other conduits or oil field equipment, with other pieces of oil field equipment; provide quick and efficient connection of each of the oil field lines, and other conduits or oil field equipment, with other pieces of oil field equipment; and reduce the amount of manpower needed to remove and install the oil field lines, and other conduits or oil field equipment, with other pieces of oil field equipment.

SUMMARY OF INVENTION

In accordance with the invention, the foregoing advantages have been achieved through the present coupling system for releaseably connecting an oil field line to at least one piece of oil field equipment comprising: a first coupling member in fluid communication with the at least one piece of oil field equipment; and a second coupling member in fluid communication with the oil field line, wherein the first coupling member and the second coupling member are each adapted to be releaseably connected to each other, and wherein the first coupling member and the second coupling member are each adapted to be releaseably connected to each other to form a breechblock connection.

A further feature of the coupling system is that the first coupling member may include a connection member having a lumen, and a breechblock housing member, wherein the breechblock housing member is permitted to rotate at least 30 degrees. Another feature of the coupling system is that the connection member may include at least one seal. An additional feature of the coupling system is that the second coupling member may include at least one seal. Still another feature of the coupling system is that the breechblock housing member may be permitted to rotate 360 degrees. A further feature of the coupling system is that the connection member may include a cap having a port and a removable port plug. Another feature of the coupling system is that the oil field line may be selected from the group consisting of kelly lines, choke and kill lines, mud tank lines, water tank lines, shale shaker lines, discharge lines, flare lines, supply lines, lines between floating vessels, boats and ships, pneumatic lines, hydraulic lines, mud lines, water lines, slurry lines, liquid natural gas lines, and fluid transfer lines. An additional feature of the coupling system is that the at least one piece of oil field equipment may be selected from the group consisting of a tensioner, a slip-joint assembly, a slip-joint tensioner assembly, a blowout preventer, a standpipe manifold, a top drive, a choke and kill manifold, a water tank, a mud tank, a pressure lubricator, a piece of wire line equipment, a piece of coiled tubing equipment, a well-head adapter, a bottom hole test adaptor, and a shale shaker.

In accordance with the invention, the foregoing advantages have been achieved through the present coupling system for releaseably connecting a first piece of oil field equipment to a second piece of oil field equipment, the coupling system comprising: a first coupling member in fluid communication with a first piece of oil field equipment, the first coupling member including a connection member having a lumen and a breechblock housing member, wherein the breechblock housing member is permitted to rotate at least 30 degrees; and a second coupling member in fluid communication with a second piece of oil field equipment, wherein the first coupling member and the second coupling member are each adapted to be releaseably connected to each other, and wherein the first coupling member and the second coupling member are each adapted to be releaseably connected to each other to form a breechblock connection.

A further feature of the coupling system is that the connection member may include at least one seal. Another feature of the coupling system is that the second coupling member may include at least one seal. An additional feature of the coupling system is that the breechblock housing member may be permitted to rotate 360 degrees.

In accordance with the invention, the foregoing advantages have been achieved through the present coupling system for releaseably connecting a first oil field line to a second oil field line, the coupling system comprising: a first coupling member in fluid communication with a first oil field line; and a second coupling member in fluid communication with a second oil field line, wherein the first coupling member and the second coupling member are each adapted to be releaseably connected to each other, and wherein the first coupling member and the second coupling member are each adapted to be releaseably connected to each other to form a breechblock connection.

A further feature of the coupling system is that each of the first and second oil field lines may be selected from the group consisting of kelly lines, choke and kill lines, mud tank lines, water tank lines, shale shaker lines, discharge lines, flare lines, supply lines, lines between floating vessels, boats and ships, pneumatic lines, hydraulic lines, mud lines, water lines, slurry lines, liquid natural gas lines, and fluid transfer lines.

In accordance with the invention, the foregoing advantages have been achieved through the present improved oil field line, the improvement comprising: at least one coupling member in fluid communication with the oil field line, wherein at least one of the at least one coupling members is adapted to form a breechblock connection.

A further feature of the improved oil field line is that the oil field line may be selected from the group consisting of kelly lines, choke and kill lines, mud tank lines, water tank lines, shale shaker lines, discharge lines, flare lines, supply lines, lines between floating vessels, boats and ships, pneumatic lines, hydraulic lines, mud lines, water lines, slurry lines, liquid natural gas lines, and fluid transfer lines.

In accordance with the invention, the foregoing advantages have been achieved through the present improved piece of oil field equipment, the improvement comprising: at least one coupling member in fluid communication with the piece of oil field equipment, the at least one coupling member having a connection member having a lumen and a breechblock housing member, the breechblock housing member being permitted to rotate at least 30 degrees, wherein at least one of the at least one coupling members is adapted to form a breechblock connection.

A further feature of the improved piece of oil field equipment is that the breechblock housing member may be permitted to rotate 360 degrees. Another feature of the improved piece of oil field equipment is that the oil field equipment may be selected from the group consisting of a tensioner, a slip-joint assembly, a slip-joint tensioner assembly, a blowout preventer, a standpipe manifold, a top drive, a choke and kill manifold, a water tank, a mud tank, a pressure lubricator, a piece of wire line equipment, a piece of coiled tubing equipment, a well-head adapter, a bottom hole test adaptor, and a shale shaker.

In accordance with the invention, the foregoing advantages have also been achieved through the present line system for a piece of oil field equipment comprising: a line having a first line end and a second line end, the first line end having a first breechblock coupling member and the second end being adapted to be in fluid communication with a fluid source; and a second breechblock coupling member in fluid communication with the oil field equipment, wherein the first breechblock coupling member is releaseably connected to the second breechblock coupling member to form a breechblock connection between the line and the oil field equipment.

A further feature of the line system is that the line may be a pressure line. Another feature of the line system is that the line may be a conduit.

The coupling system of the invention, when compared with previously proposed coupling systems, have the advantages of: providing quick and efficient connection of each of oil field lines, and other conduits or oil field equipment, with other pieces of oil field equipment; reducing the amount of manpower needed to remove and install oil field lines, and other conduits or oil field equipment, with other pieces of oil field equipment; providing quick and efficient connection of each of the oil field lines, and other conduits or oil field equipment, with other pieces of oil field equipment; and reducing the amount of manpower needed to remove and install the oil field lines, and other conduits or oil field equipment, with other pieces of oil field equipment.

Figure 1:
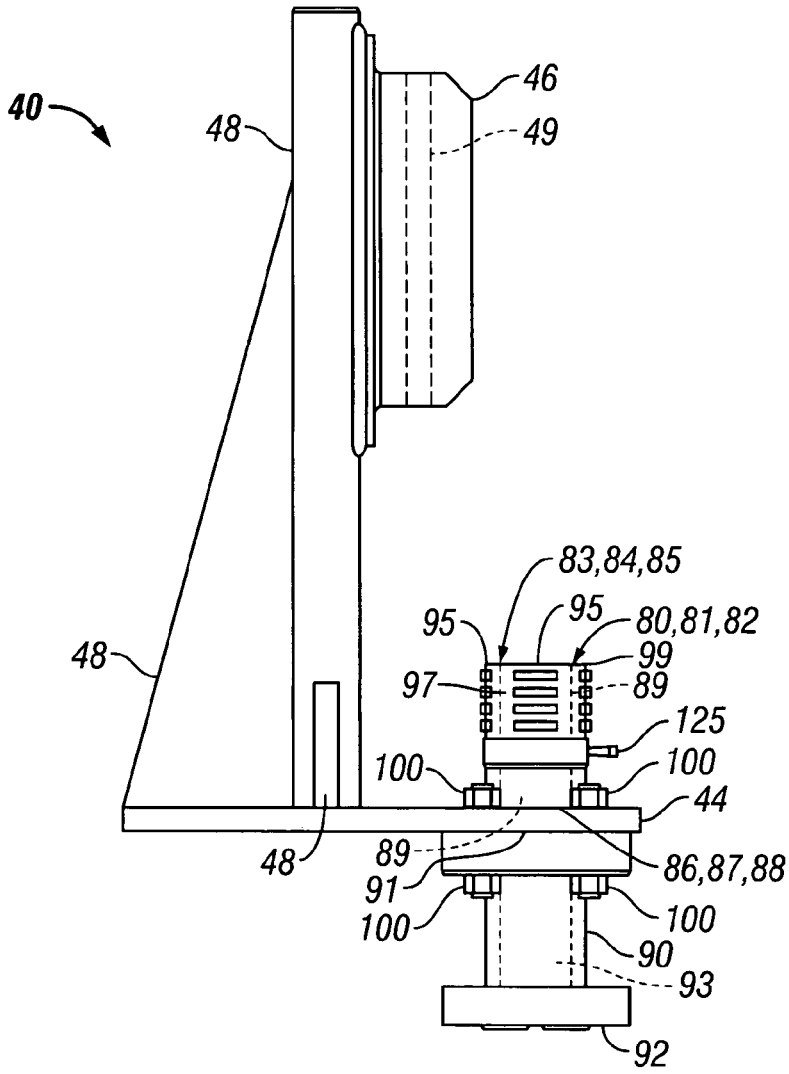
FIG. 1 is a side view of a plate assembly of one specific embodiment of the present invention.
Figure 2:
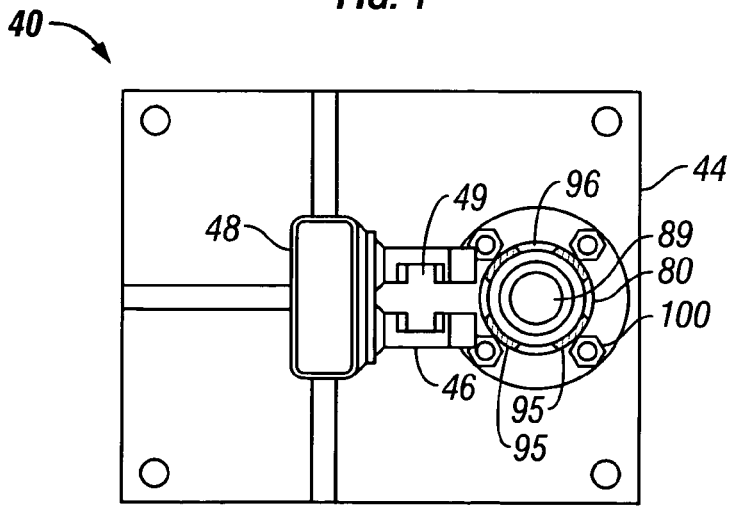
FIG. 2 is a top view of the plate assembly shown in FIG. 1.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION AND SPECIFIC EMBODIMENTS

Broadly, in one aspect, the present invention is directed to the use of breechblock connections between various oil field lines for use with oil field equipment associated with drilling and production risers or with oil and gas exploration, drilling, and production. As mentioned above, the invention will be discussed in greater detail with respect to breechblock connections of pressure lines, and in particular, pressure lines associated with riser equipment, such as tensioners, slip-joint assemblies, slip-joint tensioner assemblies, and choke and kill lines for use on blowout preventers, and specifically, different sized blowout preventers. However, it is understood that the breechblock connections of the present invention may be used on any piece of oil field equipment, oil field lines, conduits, or pressure or non-pressure lines connected to, or between, any piece of oil field equipment, including, but not limited to any piece or component of oil and gas exploration, drilling, or production, which is connected to oil field lines, conduits, or other pieces of oil field equipment, whether upon land, sea, or sub-sea, such as, pressure and non-pressure activated pieces of oil field equipment, such as tensioners, slip-joint assemblies, slip-joint tensioner assemblies, blowout preventers, choke and kill lines, kelly hose connections, top drive connections, standpipe manifolds, choke and kill manifolds, mud tank hook-ups and lines, water tank hook-ups and lines, pressure lubricators, wire line equipment, coiled tubing equipment, well-head adapters, bottom hole test adaptors, shale shaker hook-ups and lines, discharge lines, flare lines, supply lines, hoses between floating vessels, boats and ships, air lines, hydraulic lines, mud lines, water lines, slurry lines, liquid natural gas lines, and fluid transfer lines.

In one specific embodiment, the pressure lines are choke and kill lines for use with BOP stacks. In another specific embodiment, the pressure lines are utilized with various riser equipment, such as tensioners, slip-joint assemblies, and slip-joint tensioner assemblies. The use of the breechblock connections permit quick and easy installation and removal of the pressure lines from the BOP stacks and the riser equipment.

In another aspect, the invention is directed to a coupling system for use on or in connection with BOP stacks to permit quick and easy installation and removal of pressure lines from the BOP stacks.

In all of the embodiments, the pressure in each of the pressure lines may be created pneumatically, hydraulically, by drilling mud, by drilling fluid, or by any other method known to persons skilled in the art.

Figure 3:
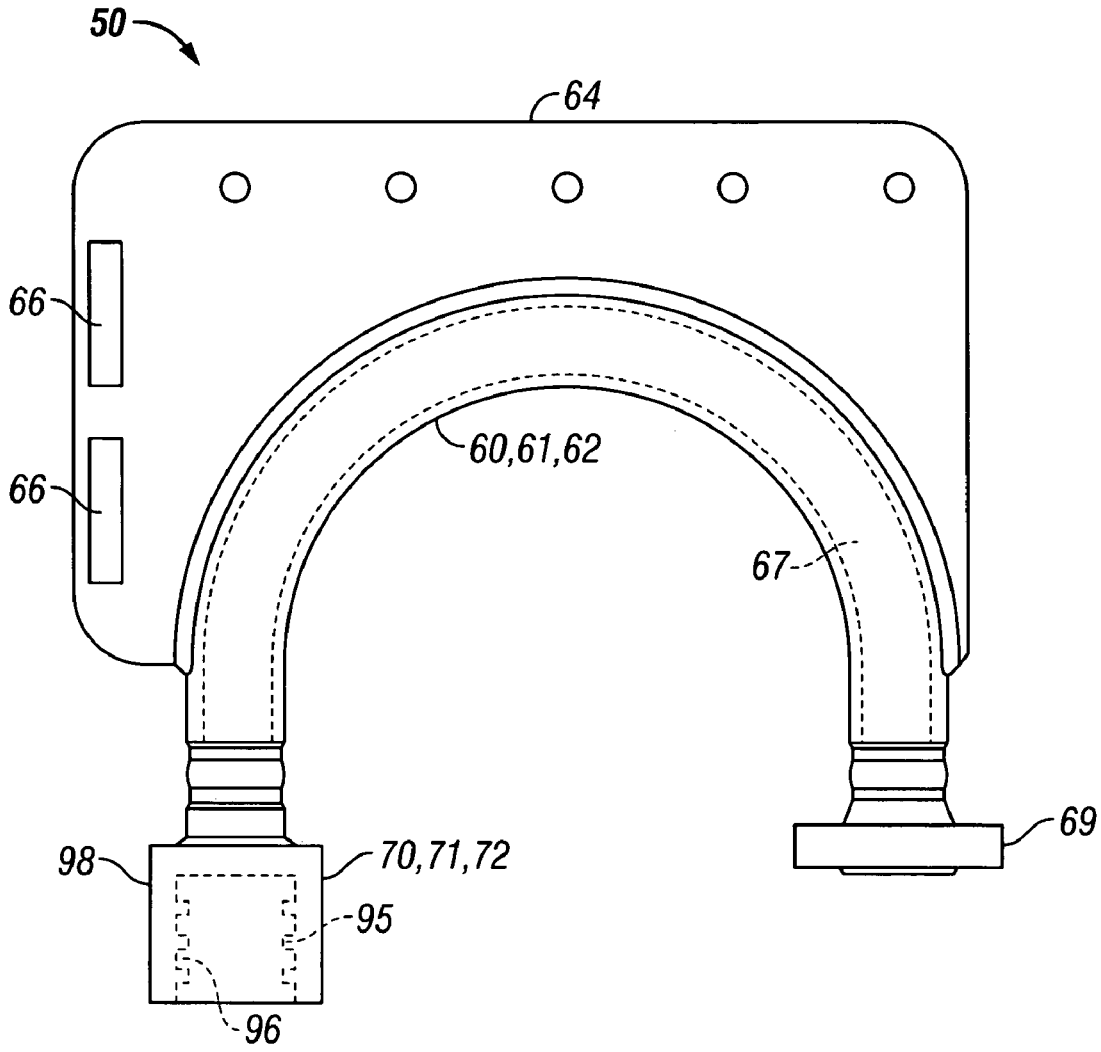
FIG. 3 is a side view of a line assembly of one specific embodiment of the present invention.
Figure 4:
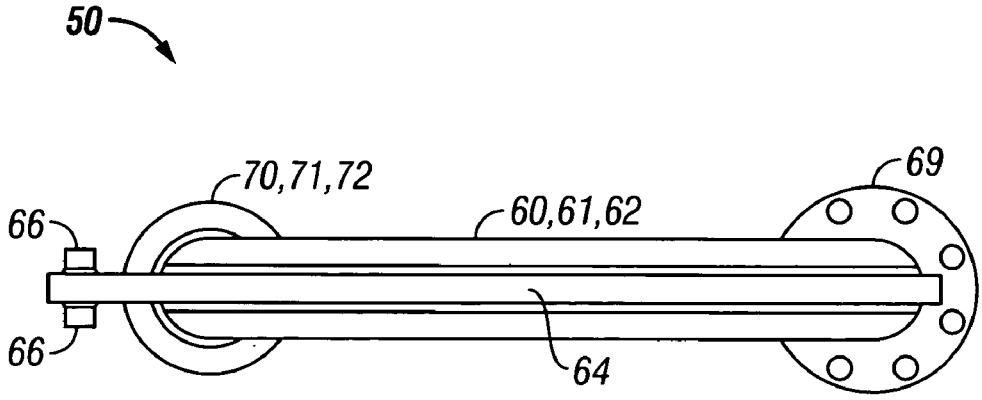
FIG. 4 is a top view of the line assembly shown in FIG. 3.
Figure 5:
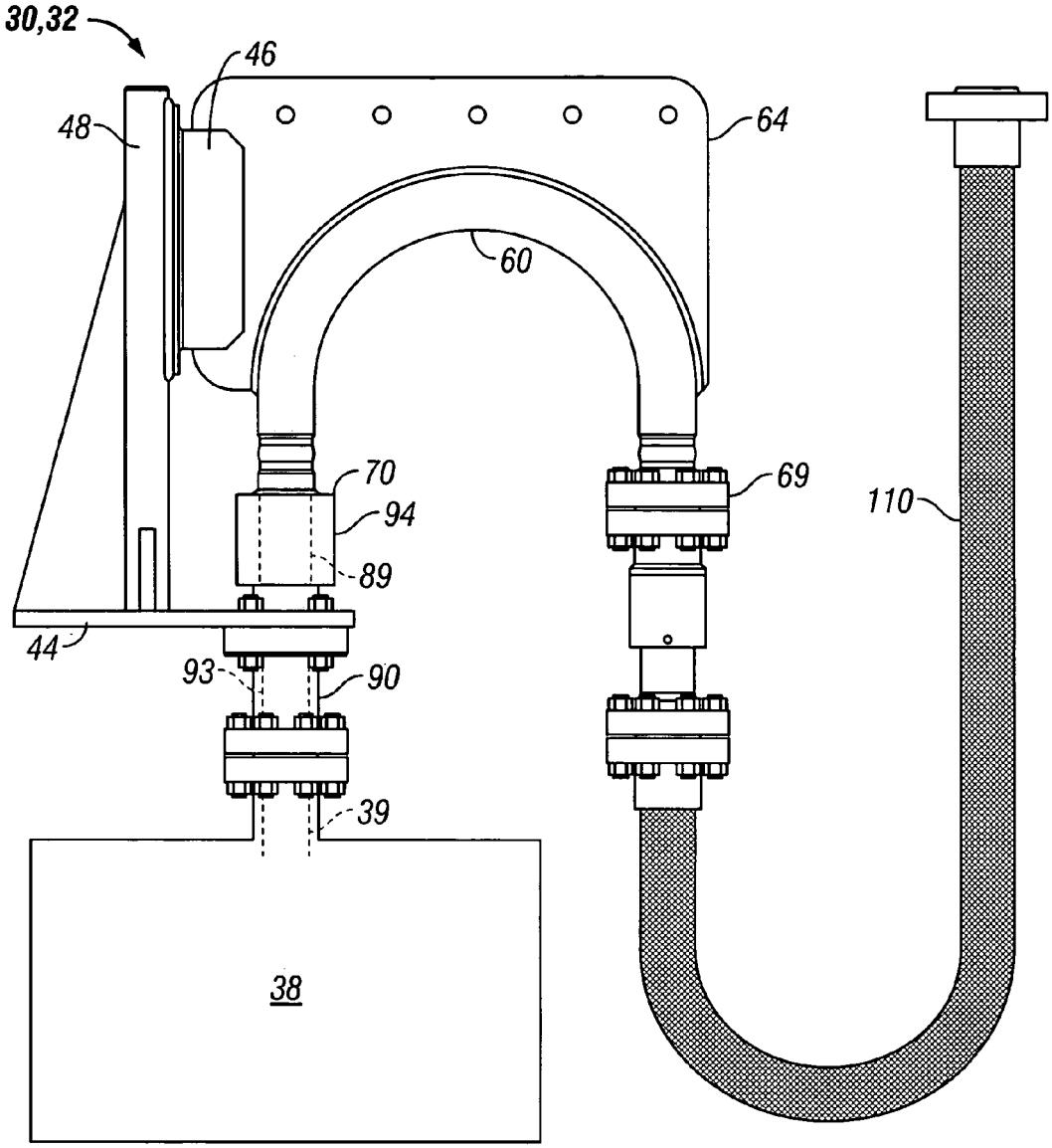
FIG. 5 is a side view of one specific embodiment of the coupling system of the present invention.
Figure 6:
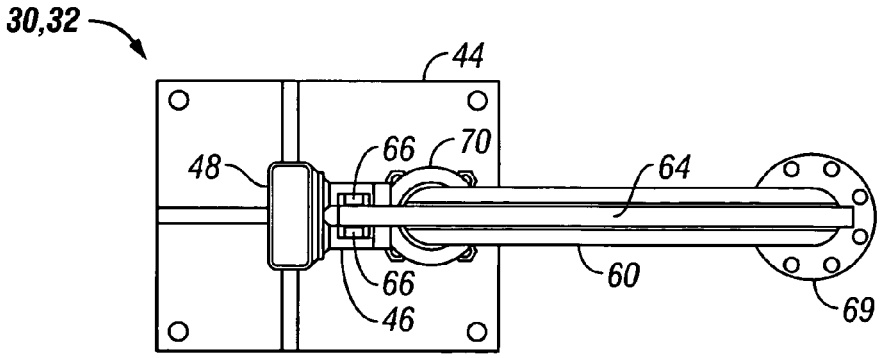
FIG. 6 is a top view of the coupling system shown in FIG. 7.

Referring now to FIGS. 1–8, in one aspect, the invention is directed to coupling system 30 which is, in this embodiment, choke and kill line system 32 for releaseably connecting line 60 to blowout preventer 38 (FIG. 5). Broadly, coupling system 30 includes plate assembly 40 and line assembly 50. Line 60 may be choke line 61 or kill line 62.

Plate assembly 40 includes plate 44, plate guide member 46 and plate guide support member 48. Plate guide member 46 includes groove 49 to facilitate the alignment of line assembly 50 with plate assembly 40 to releaseably connect line 60, choke line 61, or kill line 62 to blowout preventer 38. Alternatively, plate guide member 46 may include one or more flanges to facilitate the alignment of line assembly 50 with plate assembly 40 to releaseably connect line 60, choke line 61, or kill line 62 to blowout preventer 38. In the embodiment shown in FIGS. 1–4 and 7–8, flange 66 is adapted to be inserted into groove 49.

Figure 7:
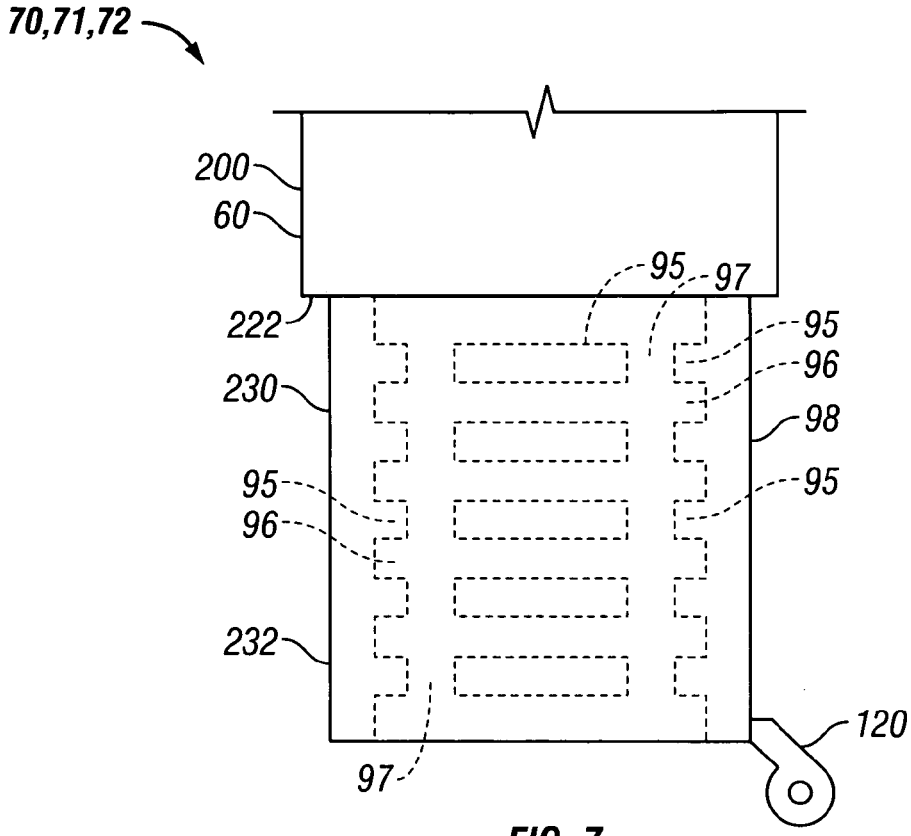
FIG. 7 is a side view of a female line coupling member of one specific embodiment of the present invention.

Plate 44 also includes line coupling member 80 having cavity or lumen 89 for permitting fluid to pass through line coupling member 80. Line coupling member 80 may be choke line coupling member 81 or choke line coupling member 82 depending on whether a choke line 61 or a kill line 62 is being releaseably connected to line coupling member 80. Line coupling member 80 includes first end 83 which may be a first choke line end 84 or a first kill line end 84. Line coupling member 80 also includes second end 86 which may be a second choke line end 87 or a second kill line end 88. Second end 86 may be secured directly to blowout preventer 38 or may be connected to blowout preventer coupling member 90 as shown in FIGS. 1 and 7 which is then secured to blowout preventer 38. Blowout preventer coupling member 90 includes cavity or lumen 93 for permitting fluid to pass through blowout preventer coupling member 90 and into blowout preventer 38 through blowout preventer passageway 39. In this specific embodiment, blowout preventer coupling member 90 is disposed along, or connected to, line coupling member 80 to facilitate securing line coupling member 80 to blowout preventer 38.

As shown in FIGS. 1 and 7, blowout preventer coupling member 90 is a separate member that is secured at first end 91 of blowout preventer coupling member 90 to plate 44 by bolts 100. Second end 92 of blowout preventer coupling member 90 is secured to blowout preventer 38.

Line coupling member 80 is secured to plate 44 by bolts 100 or other devices and methods known to persons of ordinary skill in art, e.g., welding, threaded connection, or forming line coupling member 80 integral with plate 44, such that line coupling member 80 is in fluid communication with blowout preventer coupling 90. In this embodiment, second end 86 of line coupling member 80 is secured to plate 44.

In another specific embodiment, line coupling member 80 and blowout preventer coupling 90 are formed integral with plate 44 such that bolts 100 are not necessary.

Referring now to FIGS. 3–4, line assembly 50 includes line 60 (which may be choke line 61 or kill line 62) having cavity or lumen 67 for permitting fluid to pass through line 60. Line assembly 50 also includes line assembly guide member 64 and line coupling member 70. Line coupling member 70 may be choke line coupling member 71 or kill line coupling member 72 depending on whether a choke line 61 or a kill line 62 is being releaseably connected to line coupling member 70.

Line 60, choke line 61, and kill line 62 preferably include swivel connector 69 to facilitate connection of line assembly 50 to swivel assembly 110 (FIG. 7) to provide easy maneuvering of line assembly 50 for releaseably securing line 60, choke line 61 or kill line 62 to plate assembly 40.

Line assembly guide member 64 may include one or more flanges 66 to facilitate the alignment of line assembly 50 with plate 44 to releaseably connect line 60, choke line 61, or kill line 62 to blowout preventer 38. Alternatively, line assembly guide member 64 may include one or more grooves to facilitate the alignment of line assembly 50 with plate 44 to releaseably connect line 60, choke line 61, or kill line 62 to blowout preventer 38. In the embodiment shown in FIGS. 1–4 and 7–8, flange 66 is adapted to be inserted into groove 49.

Line coupling member 70 and line coupling member 80 may be releaseably secured to each other to form any type of connection known to persons of ordinary skill in the art. For example, line coupling member 70 may be releaseably secured to line coupling member 80 using a clamp, using bolted flanges, using a threaded connection, or using an external locking device, such as a pin, lock lug, or set screw, by which line coupling member 70 is externally connected to line coupling member 80. In a preferred embodiment, line coupling member 70 is releaseably secured to line coupling member 80 to form a breechblock connection 94 (FIGS. 1, 3, 5–7).

While breechblock connections are known by persons skilled in the art, briefly, in ones embodiment, breechblock connection 94 is formed by segmented teeth 95 having teeth valleys 96 therebetween for receiving segmented teeth 95. Segmented teeth 95 may be any shape or size desired or necessary to facilitate releaseably securing line coupling member 70 to line coupling member 80. For example, in one specific embodiment, each of the segmented teeth 95 are rectangularly shaped having 90 degree angled corners and sides. In another specific embodiment, each of the segmented teeth 95 are trapezoidally shaped having corners and sides angled at degrees other than 90 degrees. In still other embodiments, segmented teeth 95 may be tapered, helical or serrated.

In the embodiment shown in FIGS. 1, 3, and 5–7, line coupling member 70 is female coupling member 98 having segmented teeth 95, teeth valleys 96, and breechblock slots 97; and line coupling member 80 is male coupling member 99 having segmented teeth 95 and breechblock slots 97. Line coupling member 80 is inserted into line coupling member 70 by passing segmented teeth 95 disposed along line coupling member 80 through breechblock slots 97 disposed along line coupling member 70; and, thus, passing segmented teeth 95 disposed along line coupling member 70 through breechblock slots 97 disposed along line coupling member 80. After line coupling member 80 is fully inserted into line coupling member 70, line coupling member 80 or line coupling member 70 is rotated such that segmented teeth 95 of line coupling member 70 are disposed within teeth valleys 96 and thus, between segmented teeth 95 of line coupling member 80, and segmented teeth 95 of line coupling member 80 are disposed within teeth valleys 96 and thus, between segmented teeth 95 of line coupling member 70.

A set screw 125 or lock lug 120, 122 disposed along line coupling members 70, 80 may be used to secure line coupling member 70 to line coupling member 80 and to prevent vibrational forces from inadvertently rotating and releasing line coupling member 70 from line coupling member 80.

As mentioned above, line coupling member 70 and line coupling member 80 may be female coupling members 98 or male coupling members 99. As shown in FIGS. 1 and 3, line coupling member 70 is female coupling member 98 and line coupling member 80 is male coupling member 99. It is to be understood, however, that any combination of female coupling members 98 and male coupling members 99 may be utilized in forming the connection between line 60 and blowout preventer 38.

Female coupling member 98 and male coupling member 99 may be any connector system known to persons skilled in the art. For example, the connection of female coupling member 98 with male coupling member 99 may be formed by a use of a clamp, use of bolted flanges, a threaded connection, an external locking device, such as a pin, lock lug, or set screw, by which female coupling member 98 is externally connected to male coupling member 99, or any other device or method known to persons of skilled in the art. However, as shown in FIGS. 1, 3, and 5–7, in a preferred embodiment, the female coupling member 98 and the male coupling member 99 form breechblock connection 94.

Figure 9:
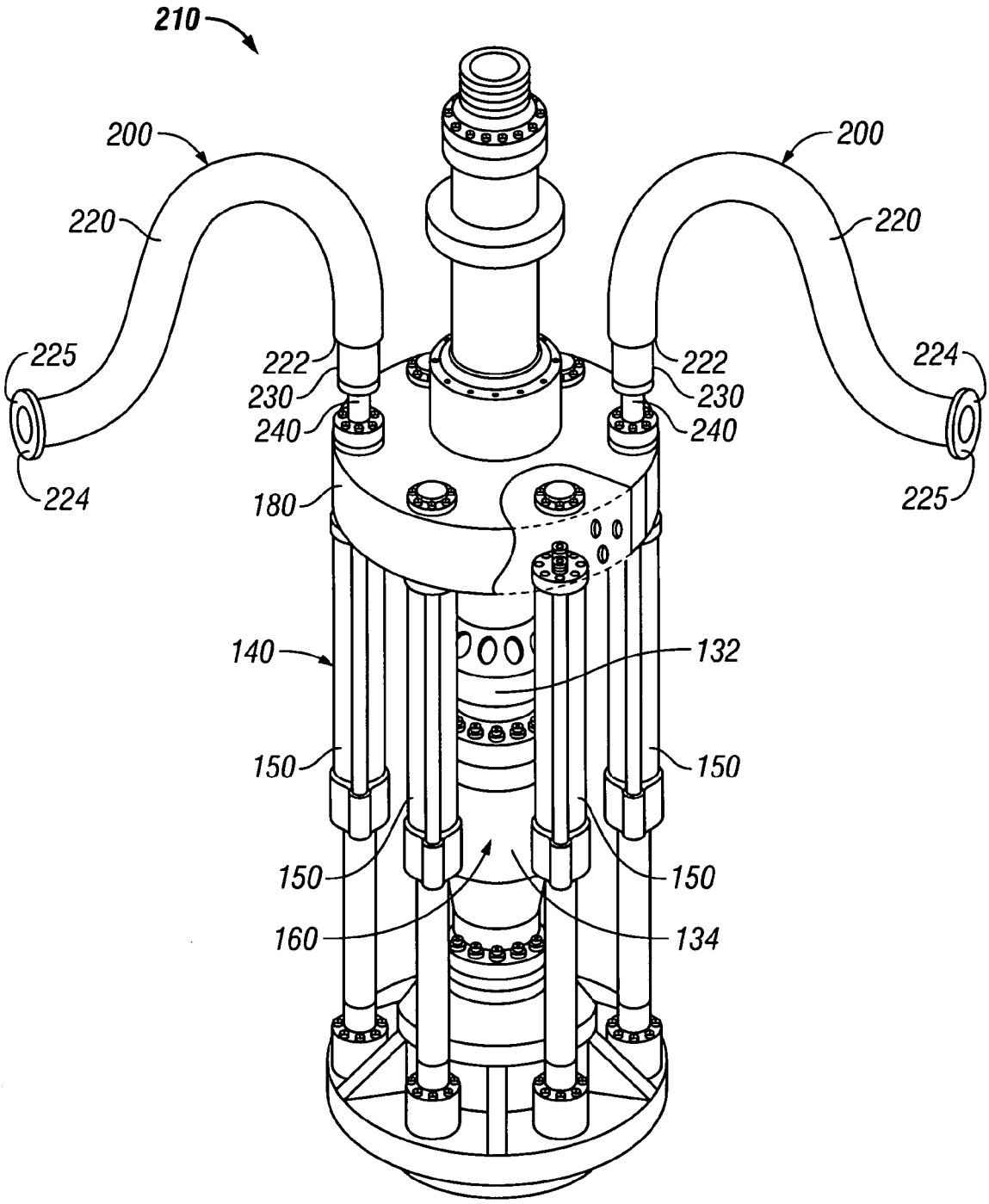
FIG. 9 is a perspective view of a slip-joint tensioner assembly having a specific embodiment of the pressure line system of the present invention.

Referring now to FIG. 9, in another specific embodiment of the invention, pressure lines 200 are used in connection with riser equipment 210. As mentioned above, riser equipment may be a tensioner, a slip-joint assembly, or a slip-joint tensioner assembly, all of which are known in the art. FIG. 9 shows a slip-joint tensioner assembly 120 as disclosed in U.S. Pat. No. 6,530,430, entitled "Tensioner/Slip-Joint Assembly," which is incorporated herein by reference; however, it is to be understood that by removing the inner and outer slip-joint barrels 132, 134, FIG. 9 illustrates a tensioner 140. Additionally, by removing the cylinders 150, FIG. 9 illustrates a slip-joint assembly 160.

While FIG. 9 is directed to one specific tensioner, slip-joint assembly, and slip-joint tensioner, it is to be understood that any riser equipment, or any tensioner, slip-joint assembly, and slip-joint tensioner, may be used in connection with pressure line 200.

Pressure line 200 includes line 220 having first pressure line end 222 and second pressure line end 224. Second pressure line end 224 is adapted to be in fluid communication with a fluid source (not shown) such as air pressure vessels, hydraulic fluid reservoir, drilling mud reservoir, etc., through flange 225 or other similar component readily known by persons skilled in the art for connecting second pressure line end 224 to the fluid source. First pressure line end 222 includes a pressure line coupling member 230 (FIGS.7 and 9). Riser equipment 210 also includes pressure line coupling member 240 (FIGS. 8 and 9) as a component of the control interface of riser equipment 210 so that riser equipment 210 may be operated. Pressure line coupling member 240 is in fluid communication with the pressure activated components of riser equipment, such as cylinders 150 and slip-joint assembly 160 (inner and outer slip-joint barrels 132,134) through radial manifold 180.

Figure 8:
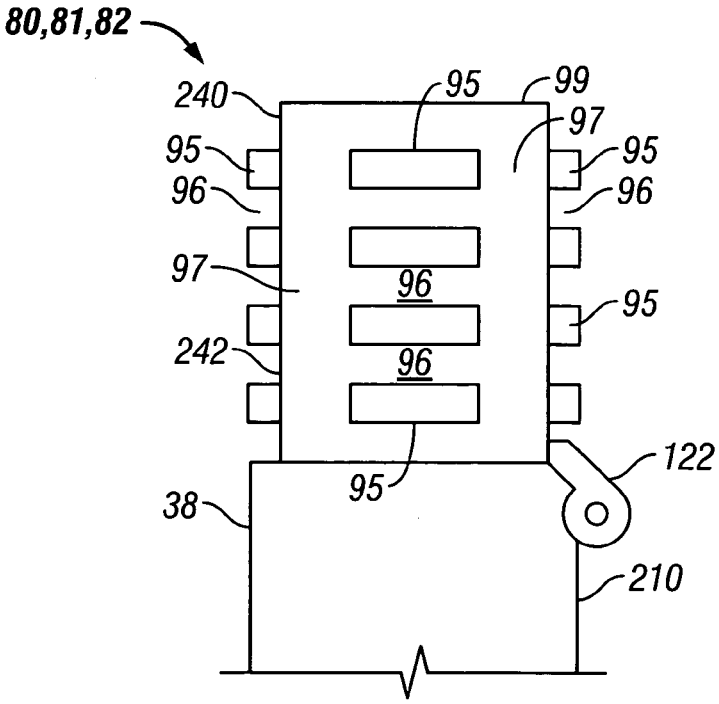
FIG. 8 is a side view of a male line coupling member of one specific embodiment of the present invention.

While pressure line coupling members 230,240 are shown in FIGS. 7–9 as being female line coupling member 232 and male coupling member 242, respectively, it is to be understood that line coupling member 230 disposed on first pressure line end 222 may be male coupling member 242 or female coupling member 232, and line coupling member 240 disposed on riser equipment 210 may be male coupling member 242 or female coupling member 232, provided that if line coupling member 230 is female coupling member 232, then line coupling member 240 must be male coupling member 242 (as shown in FIGS. 7–8); and if line coupling member 230 is male coupling member 242, then line coupling member 240 must be female coupling member 232.

In the preferred embodiment, line coupling member 230 and line coupling member 240 releaseably connect to form a breechblock connection 94 as discussed above with respect to coupling system 30 and choke and kill line system 32 (FIGS. 1–8).

While it is contemplated that the pressure lines, e.g., choke lines, kill lines, and riser equipment pressure lines, may have any diameter, and withstand any pressure, desired or necessary to supply pressure to the BOP stack or riser equipment without rupturing the pressure lines, it has been discovered that coupling system 30, choke and kill line system 32, and pressure line system 200 (FIGS. 7–9) work well in connection with choke line 70, kill line 80, and pressure line 202 (FIG. 9) having diameters greater than 2 inches and capable of withstanding 10,000 psi.

Figure 10:
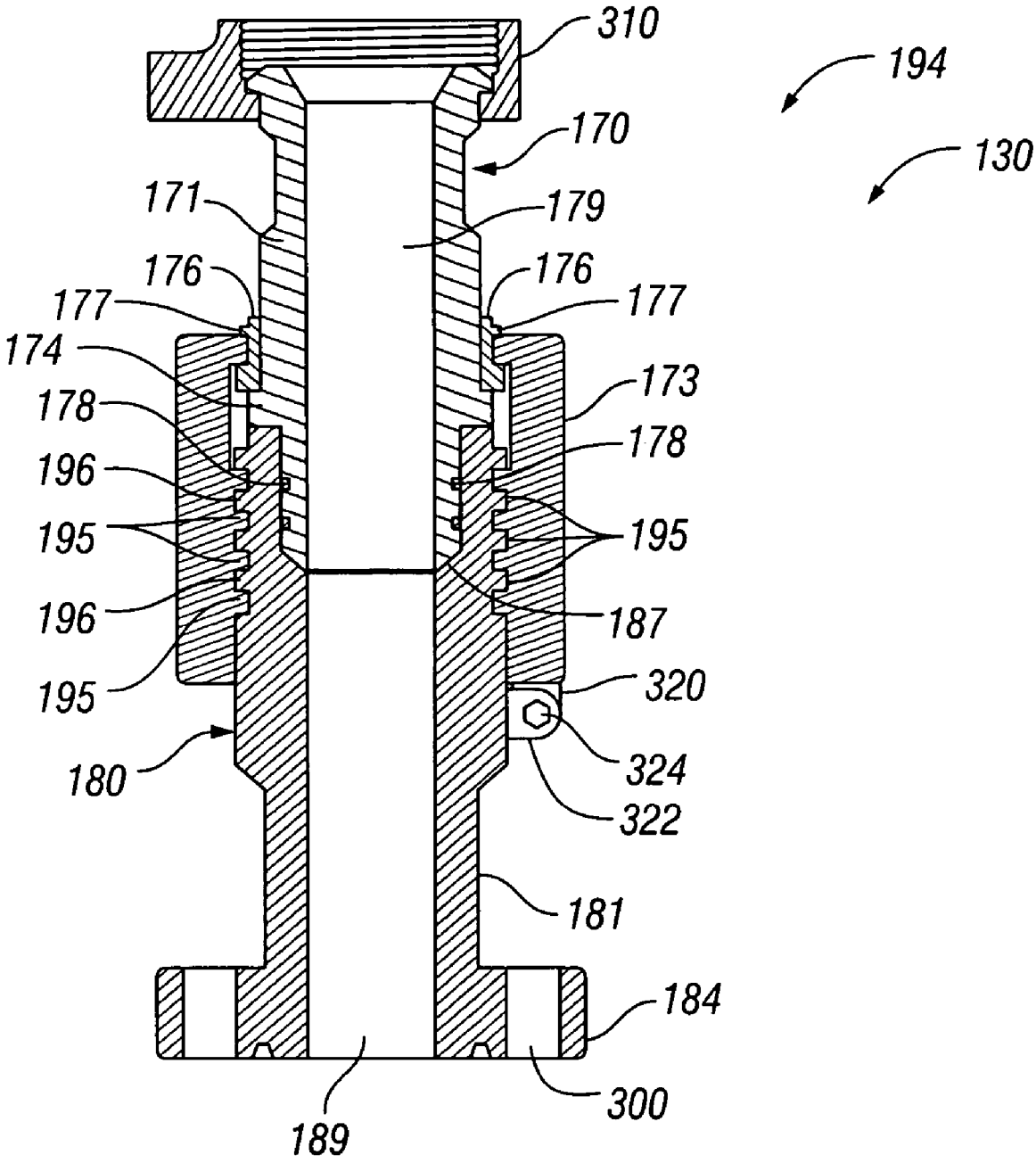
FIG. 10 is a cross-sectional side view of one specific embodiment of the breechblock connection coupling system of the present invention.

Referring now to FIG. 10, in another embodiment of the invention, coupling system 130 is breechblock connection 194 includes coupling member 170, which is a female coupling member, and line coupling member 180, which is a male coupling member. Line coupling member 170 includes connection member 171 having connection member flange 174, lumen 179, and seals 178. Line coupling member 170 also includes breechblock housing member 173 and housing flange 176. Housing flange 176 includes fastener member 177, such as a garter spring, to secure housing flange 176 and breechblock housing member 173 in place. Preferably, housing flange 176 includes three segments to facilitate installation of housing flange 176 around line coupling member 170. Breechblock housing member 173 includes segmented teeth 195, teeth valleys 196, and breechblock slots (not shown) as discussed below in greater detail above (segmented teeth 95, teeth valleys 96 and breechblock slots 97 in FIGS. 1–3, 7 and 8) and shown in FIG. 11. Breechblock housing member 173 is permitted to rotate up to 360 degrees along flange 176. Therefore, breechblock housing member 173 may be rotated to make the breechblock connection instead of requiring the oil field line or the oil field equipment to be rotated. In one embodiment, breechblock housing member 173 is permitted to rotate up at least 30 degrees along flange 176. In a preferred embodiment, breechblock housing member 173 is permitted to rotate at least 45 degrees along flange 176.

Connection flange 310 may also be included with coupling member 170 to facilitate connection of coupling member 170 to an oil field line or a piece of oil field equipment.

Coupling member 180 includes connection member 181, lumen 189, expanded lumen portion 187 for receiving coupling member 170, and segmented teeth 195, teeth valleys 196, breechblock slots (not shown). Connection flange 184 may also be connected to, or formed integral with, coupling member 180 to facilitate connection of coupling member 180 to an oil field line or to a piece of oil field equipment. Connection flange 184 preferably includes fastener holes 300 to facilitate securing coupling member 180 to an oil field line or piece of oil field equipment using fasteners such as bolts (not shown).

Preferably, breechblock housing member 173 includes lock lug 320 and coupling member 180 includes lock lug 322. Lock lug 320 and lock lug 322 are engaged with one another for receiving fastener, e.g., bolt, 324 to secure breechblock housing member 173 to coupling member 180, thereby preventing breechblock housing member 173 from further rotation.

Figure 11:
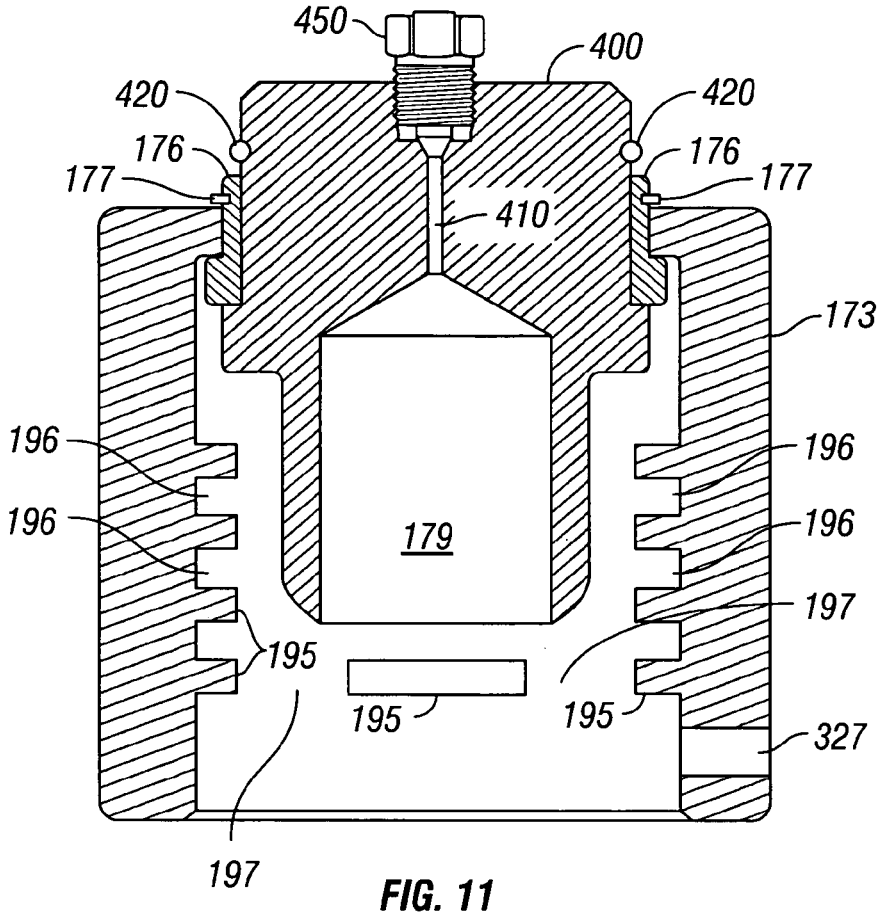
FIG. 11 is a cross-sectional side view of one specific embodiment of a coupling member of a breechblock connection of the present invention.

As illustrated in FIG. 11, in another embodiment, coupling member 170 includes cap 400. Cap 400 includes port 410 formed as part of lumen 179, removable port plug 450, and seals 420.

Figure 12:
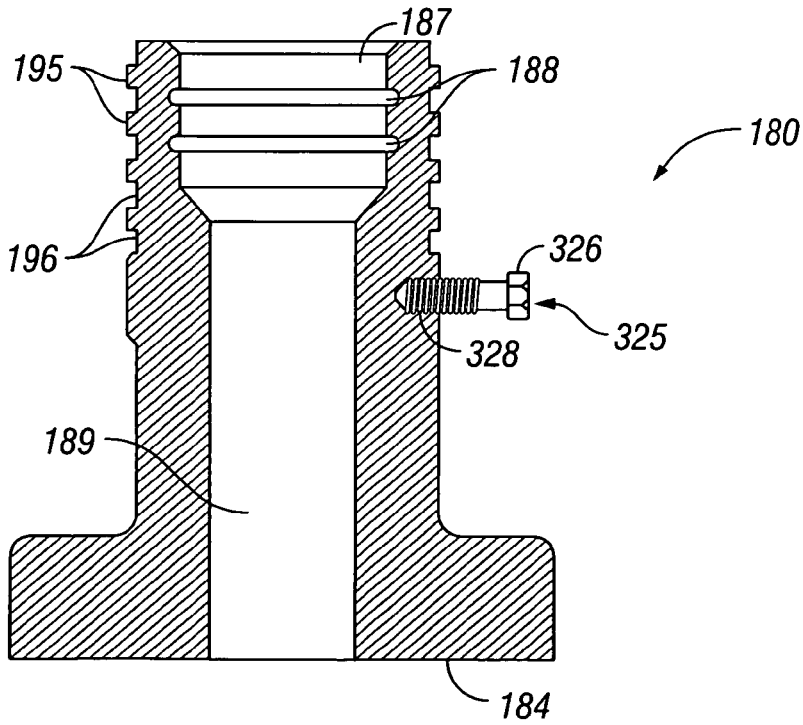
FIG. 12 is a cross-sectional side view of another specific embodiment of a coupling member of a breechblock connection of the present invention.

Referring now to FIG. 12, in another embodiment, coupling member 180 includes seals 188. Seals 188 may be used to replace seals 178 disposed along coupling member 170 (FIG. 10). Alternatively, seals 188 maybe used in combination with seals 178 disposed along coupling member 170. Also shown in this embodiment, set screw 325 prevents rotation of breechblock housing member 173 in the same manner as discussed above with respect to set screw 125 (FIG. 1). While FIG. 12 shows only one set screw 325, it is to be understood that more than one set screw 325 may be used. As shown in FIG. 12, set screw 325 is bolt 326 that is placed through hole 327 (FIG. 11), and hole 328 (FIG. 12) drilled in breechblock housing member 173 and line coupling member 180, respectively. Hole 328 is preferably tapped to receive threads (not shown) disposed along bolt 326.

It is to be understood that the invention is not limited to the exact details of construction, operation, exact materials, or embodiments shown and described, as obvious modifications and equivalents will be apparent to one skilled in the art. For example, the line assembly may be connected to the plate assembly by including a pin, bolt or other external device to secure the line assembly guide to the plate assembly guide. Additionally, as mentioned above, the plate guide member and line guide assembly member may be any shape desired or necessary to align plate assembly with line assembly. For example, the plate guide member may include a groove and the line assembly guide member may include one or more flanges adapted for insertion into the groove. Alternatively, the line assembly guide member may include a groove the plate guide member may include one or more flanges adapted for insertion into the groove. Moreover, the plate may be formed integral with the line coupling member and/or the blowout preventer coupling member; the line coupling member may be connected directly to the blowout preventer; the line coupling member may be connected directly to the blowout preventer coupling member; or the line assembly may not include a line assembly guide member. Additionally, the breechblock connections of the present invention may be used to connect two or more pieces of oil field equipment, one or more oil field lines to one or more pieces of oil field equipment, or to connect one or more oil field lines to one or more other oil field lines. Accordingly, the invention is therefore to be limited only by the scope of the appended claims.

What is claimed:

1. A coupling system for releaseably connecting an oil field line to at least one piece of oil field equipment comprising:

a first coupling member in fluid communication with the at least one piece of oil field equipment, the first coupling member having a breechblock housing member, wherein the breechblock housing member is rotatable relative to the first coupling member; and a second coupling member in fluid communication with the oil field line, wherein the first coupling member and the second coupling member are each adapted to be releaseably connected to each other, and wherein the first coupling member and the second coupling member are each adapted to be releaseably connected to each other to form a breechblock connection.

2. The coupling system of claim 1, wherein the first coupling member includes a connection member having a lumen, and wherein the breechblock housing member is permitted to rotate at least 30 degrees.

3. The coupling system of claim 2, wherein the connection member includes at least one seal.

4. The coupling system of claim 1, wherein the second coupling member includes at least one seal.

5. The coupling system of claim 2, wherein the connection member includes a cap having a port and a removable port plug.

6. The coupling system of claim 1, wherein the breechblock housing member is permitted to rotate 360 degrees.

7. The coupling system of claim 1, wherein the oil field line is selected from the group consisting of kelly lines, choke and kill lines, mud tank lines, water tank lines, shale shaker lines, discharge lines, flare lines, supply lines, lines between floating vessels, boats and ships, pneumatic lines, hydraulic lines, mud lines, water lines, slurry lines, liquid natural gas lines, and fluid transfer lines.

8. The coupling system of claim 1, wherein the at least one piece of oil field equipment is selected from the group consisting of a tensioner, a slip-joint assembly, a slip-joint tensioner assembly, a blowout preventer, a standpipe manifold, a top drive, a choke and kill manifold, a water tank, a mud tank, a pressure lubricator, a piece of wire line equipment, a piece of coiled tubing equipment, a well-head adapter, a bottom hole test adaptor, and a shale shaker.

9. A coupling system for releaseably connecting an oil field line to at least one piece of oil field equipment comprising:

a first coupling member in fluid communication with the at least one piece of oil field equipment; and a second coupling member in fluid communication with the oil field line, the second coupling member having a breechblock housing member, wherein the breechblock housing member is rotatable relative to the second coupling member, wherein the first coupling member and the second coupling member are each adapted to be releaseably connected to each other, and wherein the first coupling member and the second coupling member are each adapted to be releaseably connected to each other to form a breechblock connection.

10. The coupling system of claim 9, wherein the second coupling member includes a connection member having a lumen and at least one seal, and wherein the breechblock housing member is permitted to rotate at least 30 degrees.

11. The coupling system of claim 10, wherein the connection member includes a cap having a port and a removable port plug.

12. The coupling system of claim 9, wherein the second coupling member includes at least one seal.

13. The coupling system of claim 9, wherein the breechblock housing member is permitted to rotate 360 degrees.

14. The coupling system of claim 9, wherein the second coupling member includes a connection member having a lumen, and wherein the breechblock housing member is permitted to rotate at least 30 degrees.

15. The coupling system of claim 9, wherein the oil field line is selected from the group consisting of kelly lines, choke and kill lines, mud tank lines, water tank lines, shale shaker lines, discharge lines, flare lines, supply lines, lines between floating vessels, boats and ships, pneumatic lines, hydraulic lines, mud lines, water lines, slurry lines, liquid natural gas lines, and fluid transfer lines.

16. The coupling system of claim 9, wherein the at least one piece of oil field equipment is selected from the group consisting of a tensioner, a slip-joint assembly, a slip-joint tensioner assembly, a blowout preventer, a standpipe manifold, a top drive, a choke and kill manifold, a water tank, a mud tank, a pressure lubricator, a piece of wire line equipment, a piece of coiled tubing equipment, a well-head adapter, a bottom hole test adaptor, and a shale shaker.

17. A coupling system for releaseably connecting a first piece of oil field equipment to a second piece of oil field equipment, the coupling system comprising:

a first coupling member in fluid communication with a first piece of oil field equipment, the first coupling member including a connection member having a lumen and a breechblock housing member, wherein the breechblock housing member is rotatable relative to the first coupling member at least 30 degrees; and a second coupling member in fluid communication with a second piece of oil field equipment, wherein the first coupling member and the second coupling member are each adapted to be releaseably connected to each other, and wherein the first coupling member and the second coupling member are each adapted to be releaseably connected to each other to form a breechblock connection.

18. The coupling system of claim 17, wherein the connection member includes at least one seal.

19. The coupling system of claim 17, wherein the second coupling member includes at least one seal.

20. The coupling system of claim 17, wherein the breechblock housing member is permitted to rotate 360 degrees.

21. A coupling system for releaseably connecting a first oil field line to a second oil field line, the coupling system comprising:

a first coupling member in fluid communication with a first oil field line, the first coupling member having a connection member having a lumen, and a breechblock housing member, wherein the breechblock housing member is rotatable relative to the first coupling member; and a second coupling member in fluid communication with a second oil field line, wherein the first coupling member and the second coupling member are each adapted to be releaseably connected to each other, and wherein the first coupling member and the second coupling member are each adapted to be releaseably connected to each other to form a breechblock connection.

22. The coupling system of claim 21, wherein each of the first and second oil field lines is selected from the group consisting of kelly lines, choke and kill lines, mud tank lines, water tank lines, shale shaker lines, discharge lines, flare lines, supply lines, lines between floating vessels, boats and ships, pneumatic lines, hydraulic lines, mud lines, water lines, slurry lines, liquid natural gas lines, and fluid transfer lines.

23. An improved oil field line, the improvement comprising:

at least one coupling member in fluid communication with the oil field line, at least one of the at least one coupling members having a connection member having a lumen, and a breechblock housing member, wherein the breechblock housing member is rotatable relative to the at least one of the at least one coupling member, wherein at least one of the at least one coupling members is adapted to form a breechblock connection.

24. The improved oil field line of claim 23, wherein the oil field line is selected from the group consisting of kelly lines, choke and kill lines, mud tank lines, water tank lines, shale shaker lines, discharge lines, flare lines, supply lines, lines between floating vessels, boats and ships, pneumatic lines, hydraulic lines, mud lines, water lines, slurry lines, liquid natural gas lines, and fluid transfer lines.

25. An improved piece of oil field equipment, the improvement comprising:

at least one coupling member in fluid communication with the piece of oil field equipment, at least one of the at least one coupling members having a connection member having a lumen and a breechblock housing member, the breechblock housing member being is rotatable relative to the at least one of the at least one coupling member, wherein at least one of the at least one coupling members is adapted to form a breechblock connection.

26. The improved piece of oil field equipment of claim 25, wherein the breechblock housing member is permitted to rotate 360 degrees.

27. The improved piece of oil field equipment of claim 26, wherein the oil field equipment is selected from the group consisting of a tensioner, a slip-joint assembly, a slip-joint tensioner assembly, a blowout preventer, a standpipe manifold, a top drive, a choke and kill manifold, a water tank, a mud tank, a pressure lubricator, a piece of wire line equipment, a piece of coiled tubing equipment, a well-head adapter, a bottom hole test adaptor, and a shale shaker.

28. A line system for a piece of oil field equipment comprising:

a line having a first line end and a second line end, the first line end having a first breechblock coupling member, the first breechblock coupling member having a connection member having a lumen and a breechblock housing member, wherein the breechblock housing member is rotatable relative to the first breechblock coupling member and the second end being adapted to be in fluid communication with a fluid source; and a second breechblock coupling member in fluid communication with the piece of oil field equipment, wherein the first breechblock coupling member is releaseably connected to the second breechblock coupling member to form a breechblock connection between the line and the oil field equipment.

29. A line system for a piece of oil field equipment comprising:

a line having a first line end and a second line end, the first line end having a first breechblock coupling member, and the second end being adapted to be in fluid communication with a fluid source; and a second breechblock coupling member in fluid communication with the piece of oil field equipment, the second breechblock coupling member having a connection member having a lumen and a breechblock housing member, wherein the breechblock housing member is rotatable relative to the second breechblock coupling member, wherein the first breechblock coupling member is releaseably connected to the second breechblock coupling member to form a breechblock connection between the line and the oil field equipment.

* * * * *